US007168399B2

(12) United States Patent
Wakahara

(10) Patent No.: US 7,168,399 B2
(45) Date of Patent: Jan. 30, 2007

(54) ABNORMALITY DIAGNOSIS APPARATUS AND ENGINE COOLING SYSTEM HAVING THE SAME

(75) Inventor: Keiji Wakahara, Inazawa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/642,303

(22) Filed: Aug. 18, 2003

(65) Prior Publication Data

US 2004/0035194 A1 Feb. 26, 2004

(30) Foreign Application Priority Data

Aug. 21, 2002 (JP) ..... 2002-240894

(51) Int. Cl.
*F02D 45/00* (2006.01)

(52) U.S. Cl. ..... 123/41.15; 123/41.05

(58) Field of Classification Search ..... 123/41.02, 123/41.05, 41.15

See application file for complete search history.

(56) References Cited

U.S. PATENT DOCUMENTS 4,669,426 A * 6/1987 Hirano et al. ..... 123/41.15
4,977,862 A * 12/1990 Aihara et al. ..... 123/41.12
5,133,303 A * 7/1992 Umehara ..... 123/41.15
5,884,243 A * 3/1999 Taniguchi et al. ..... 702/183
5,979,373 A * 11/1999 Sano ..... 123/41.1
6,279,390 B1 * 8/2001 Oka et al. ..... 73/118.1
6,390,031 B1 5/2002 Suzuki et al.
6,463,892 B1 * 10/2002 Russell ..... 123/41.15
6,532,808 B1 3/2003 Matsumoto et al.
6,640,168 B2 * 10/2003 Kastner et al. ..... 701/36
6,679,201 B2 * 1/2004 Murakami et al. ..... 123/41.1
6,752,011 B2 6/2004 Matsumoto et al.

* cited by examiner

*Primary Examiner*—Noah P. Kamen
*Assistant Examiner*—Jason Benton
(74) *Attorney, Agent, or Firm*—Nixon & Vanderhye, P.C.

(57) ABSTRACT

A coolant temperature of coolant in a circulation line system is measured through a coolant temperature sensor and is controlled by controlling a flow rate control valve. The flow rate control valve is diagnosed to determine whether abnormality of the flow rate control valve exists based on behavior of the measured coolant temperature, which is measured through the coolant temperature sensor during a warm-up period of an internal combustion engine.

28 Claims, 5 Drawing Sheets

ABNORMALITY DIAGNOSIS APPARATUS AND ENGINE COOLING SYSTEM HAVING THE SAME

CROSS REFERENCE TO RELATED APPLICATION

This application is based on and incorporates herein by reference Japanese Patent Application No. 2002-240894 filed on Aug. 21, 2002.

BACKGROUND OF THE INVENTION

1. Field of the Invention

The present invention relates to an abnormality diagnosis apparatus and an engine cooling system having the same.

2. Description of Related Art

In a previously proposed engine cooling system, a bypass fluid line, which conducts coolant and bypasses a radiator, is provided. Furthermore, a thermostat valve, which switches a flow of coolant between the bypass fluid line and a fluid line connected to the radiator, is provided. When a coolant temperature is lower than a predetermined threshold temperature, which indicates an end point of an engine warm-up period, the thermostat valve is controlled to close the fluid line, which leads to the radiator, and opens the bypass fluid line to circulate the coolant through the bypass fluid line.

In place of the thermostat valve, it has been proposed to provide a flow rate control valve, which can adjust a flow rate (bypass flow rate) of coolant that passes through the bypass fluid line. During a warm-up period of the engine, the flow rate control valve switches the flow from the radiator to the bypass fluid line and adjusts the bypass flow rate to control the coolant temperature. However, in such a cooling system having the flow rate control valve, there has not been established a technique for accurately diagnosing existence of abnormality of the flow rate control valve.

SUMMARY OF THE INVENTION

The present invention addresses the above disadvantage. Thus, it is an objective of the present invention to provide an abnormality diagnosis apparatus for diagnosing abnormality of a cooling system for an internal combustion engine in a manner that allows relatively accurately determining existence of abnormality of a flow rate control means capable of adjusting a bypass flow rate of coolant.

It is another objective of the present invention to provide a cooling system that has such an abnormality diagnosis apparatus.

To achieve the objectives of the present invention, there is provided an abnormality diagnosis apparatus for diagnosing abnormality of a cooling system for an internal combustion engine. The cooling system includes a radiator, a circulation line system, a flow rate control means, and a coolant temperature sensor. The circulation line system circulates coolant through the internal combustion engine and the radiator and includes a bypass fluid line that bypasses the radiator. The flow rate control means is for controlling a bypass flow rate of the coolant flowing through the bypass fluid line. The coolant temperature sensor measures a coolant temperature of the coolant in the circulation line system. The abnormality diagnosis apparatus includes a coolant temperature control means and an abnormality diagnosis means. The coolant temperature control means is for controlling the coolant temperature of the coolant in the circulation line system by controlling the flow rate control means.

The abnormality diagnosis means is for diagnosing the flow rate control means to determine whether abnormality of the flow rate control means exists based on behavior of the measured coolant temperature, which is measured through the coolant temperature sensor during a warm-up period of the internal combustion engine. The coolant temperature control means and the abnormality diagnosis means may be integrated into the cooling system.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
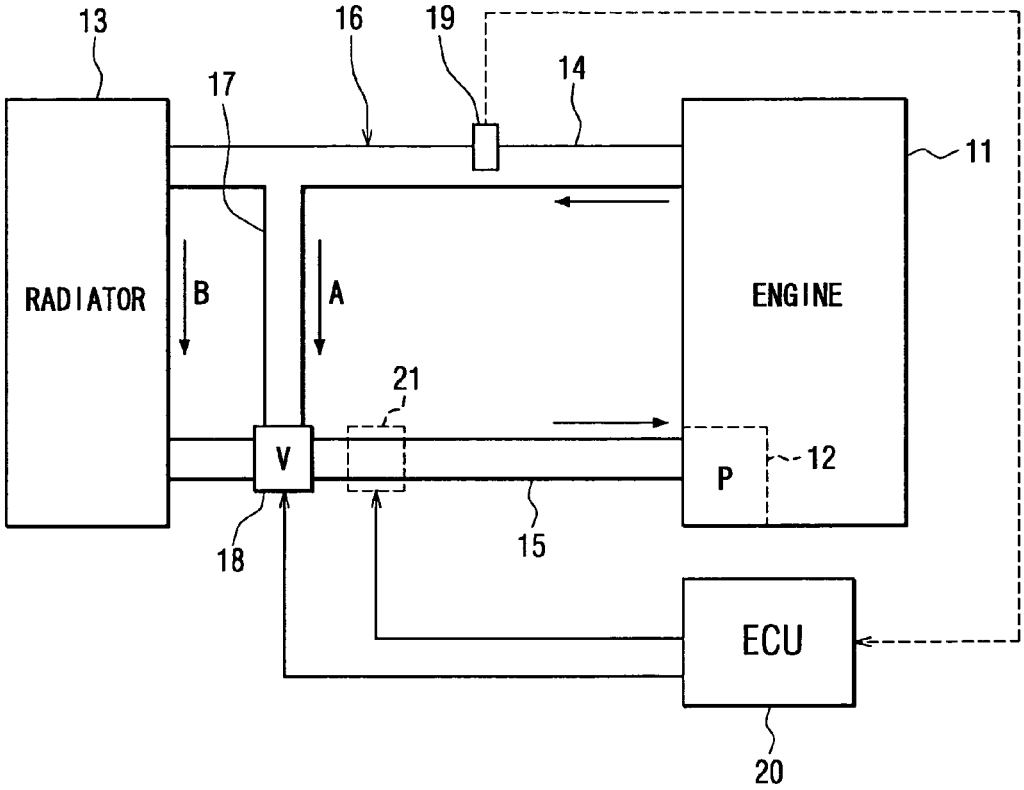
FIG. 1 is a schematic view of a cooling system according to an embodiment of the present invention.

An embodiment of the present invention will be described with reference to the accompanying drawings. First, a structure of an entire cooling system having an abnormality diagnosis apparatus will be schematically described with reference to FIG. 1. A mechanical water pump 12, which is driven by drive force of an engine (internal combustion engine) 11, is arranged in an inlet of a coolant passage (water jacket) of the engine 11. A coolant circulation line (first coolant circulation line) 14 connects between an outlet of the coolant passage of the engine 11 and an inlet of a radiator 13, and a coolant circulation line (second coolant circulation line) 15 connects between an outlet of the radiator 13 and an inlet of the mechanical water pump 12. Thus, there is constructed a circulation line system (coolant circuit) 16, in which coolant is circulated through the coolant passage of the engine 11, the coolant circulation line 14, the radiator 13, the coolant circulation line 15, the mechanical water pump 12 and the coolant passage of the engine 11 in this order.

In the circulation line system 16, a bypass fluid line 17 is provided in parallel with the radiator 13. Ends of the bypass fluid line 17 are connected to the coolant circulation lines 14, 15, respectively, at their intermediate locations. A flow rate control valve (flow rate control means) 18 is provided at a connection where the bypass fluid line 17 and the coolant circulation line 15 are connected one another. The flow rate control valve 18 is a solenoid valve, which is capable of adjusting a flow rate (bypass flow rate) A of coolant in the bypass fluid line 17 and a flow rate (radiator flow rate) B of coolant in the radiator 13.

A coolant temperature sensor 19, which measures the coolant temperature, is arranged in a portion of the coolant circulation line 14 located in the coolant outlet side of the engine 11. Output signals from the coolant temperature sensor 19 are supplied to a control circuit 20 (ECU). The control circuit (abnormality diagnosis apparatus) 20 includes a microcomputer as its main component. When the control circuit 20 executes a coolant temperature control routine of FIG. 2 stored in its ROM (storage medium), the control circuit 20 controls the flow rate control valve 18 to adjust the bypass flow rate A and the radiator flow rate B, so that the coolant temperature is controlled.

Figure 3:
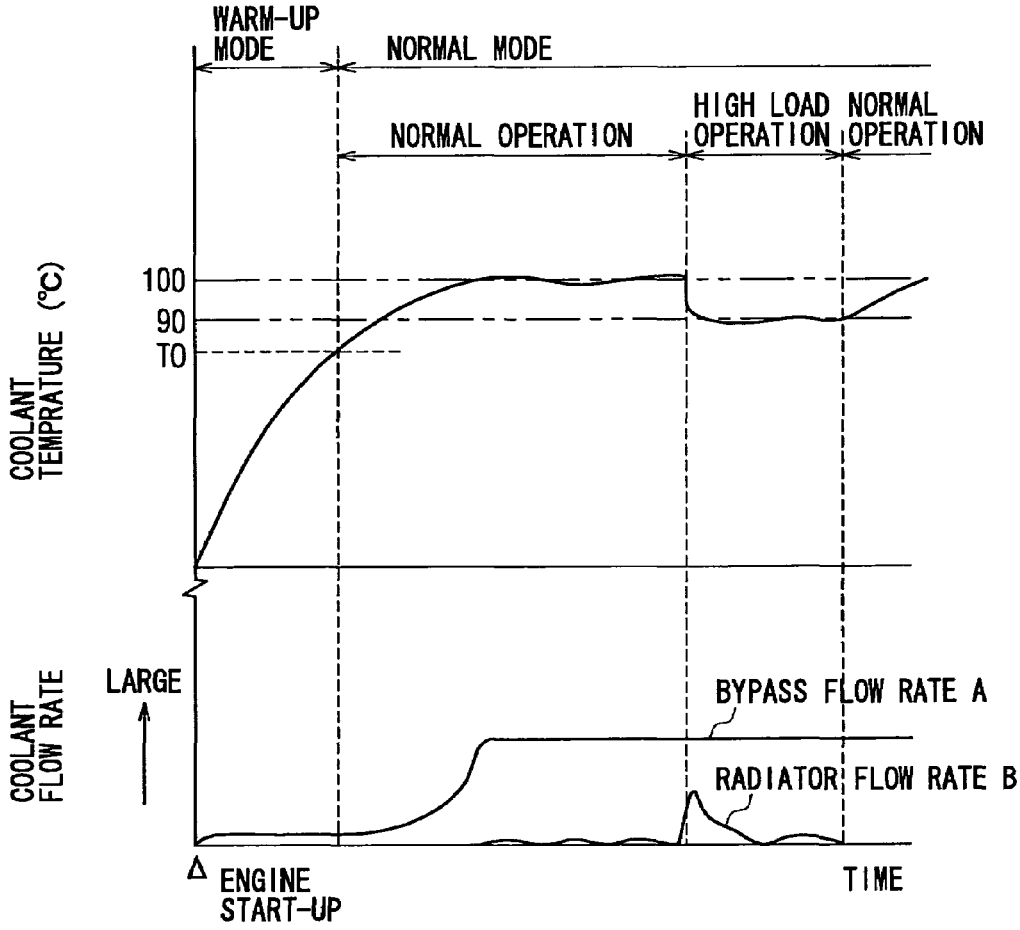
FIG. 3 is a time chart showing an exemplary coolant temperature control operation of the embodiment.

In this case, as shown in a time chart of FIG. 3, in a warm-up mode for promoting warm-up of the engine 11, a degree of opening (controlled variable) of the flow rate control valve 18 is adjusted in such a manner that the radiator flow rate B in the warm-up mode becomes zero, and the bypass flow rate A in the warm-up mode becomes smaller than the bypass flow rate A set for a normal mode (i.e., a period after the warm-up period). In this way, the flow of coolant to the radiator 13 is stopped to substantially eliminate release of heat from coolant through the radiator 13, and the bypass flow rate A is reduced to reduce the circulation flow rate of coolant. In this way, a cooling efficiency of the engine 11 is reduced to promote the warm-up of the engine 11.

On the other hand, in the normal mode after completion of the warm-up of the engine 11, a target coolant temperature is set based on a current operational state of the engine 11. Then, the degree of opening of the flow rate control valve 18 is controlled in such a manner that the bypass flow rate A and the radiator flow rate B are adjusted to corresponding set values, which are set based on a difference between the target coolant temperature and the actual coolant temperature. In this way, the coolant temperature is controlled to the target coolant temperature, which corresponds to the current operational state of the engine 11.

Figure 4:
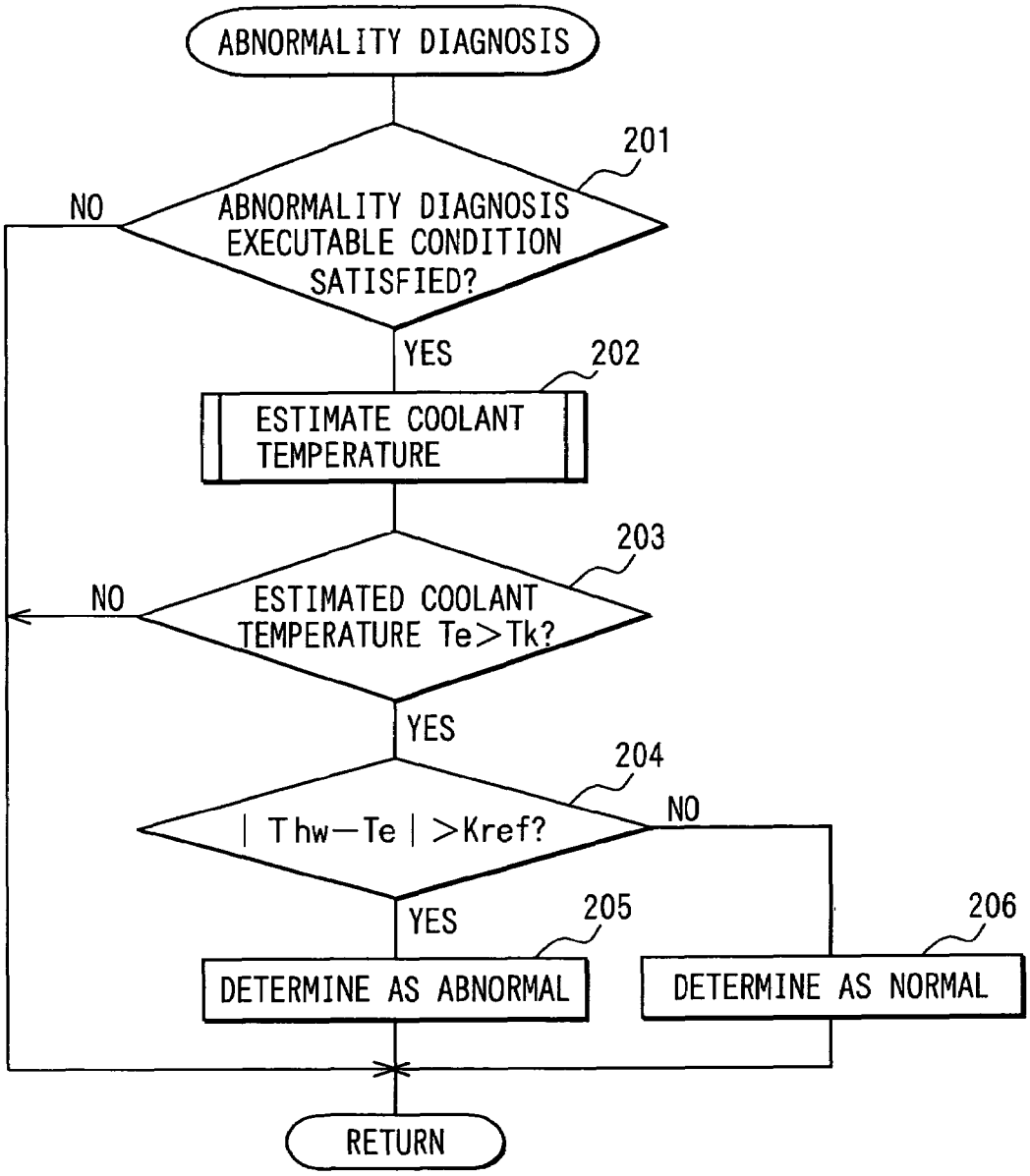
FIG. 4 is a flow chart showing an abnormality diagnosis routine of the embodiment.
Figure 5:
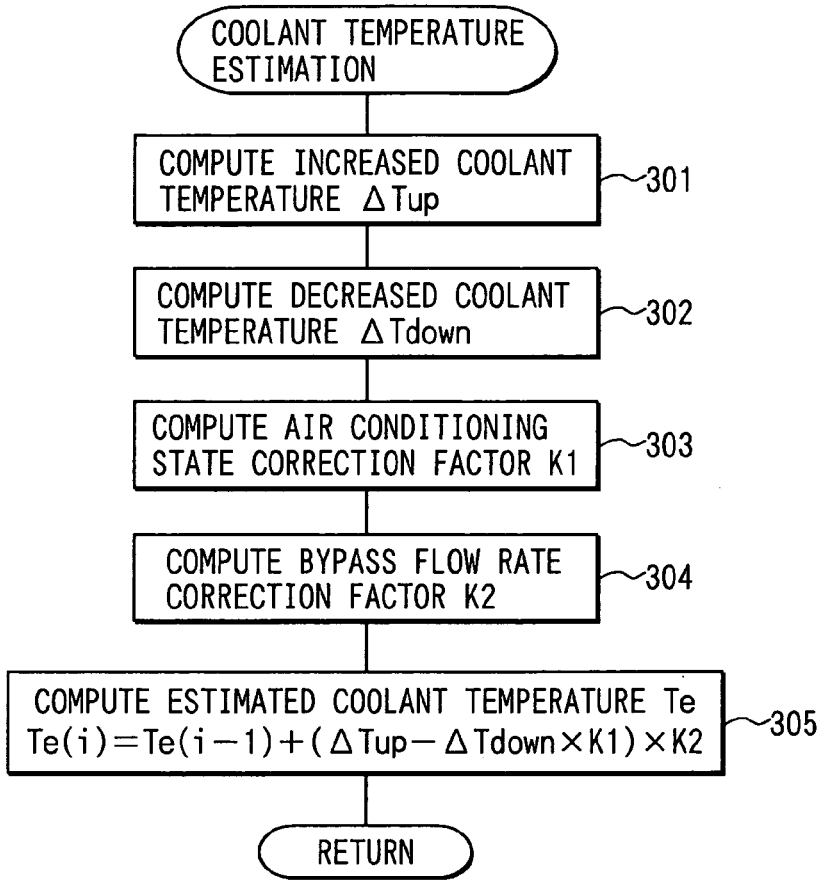
FIG. 5 is a flow chart showing a coolant temperature estimation routine of the embodiment.

Furthermore, the control circuit 20 executes an abnormality diagnosis routine shown in FIGS. 4 and 5. Thus, the coolant temperature is estimated at the time of warm-up of the engine 11 based on a parameter, which relates to an amount of heat generated by the engine 11 (amount of heat conducted from the engine 11 to coolant) and a parameter, which relates to an amount of heat released from coolant. Then, it is determined whether the flow rate control valve 18 is abnormal through comparison of the estimated coolant temperature and the actual coolant temperature measured through the coolant temperature sensor 19. Each routine of FIGS. 2, 4 and 5 executed by the control circuit 20 will be described.

(Coolant Temperature Control Routine)

Figure 2:
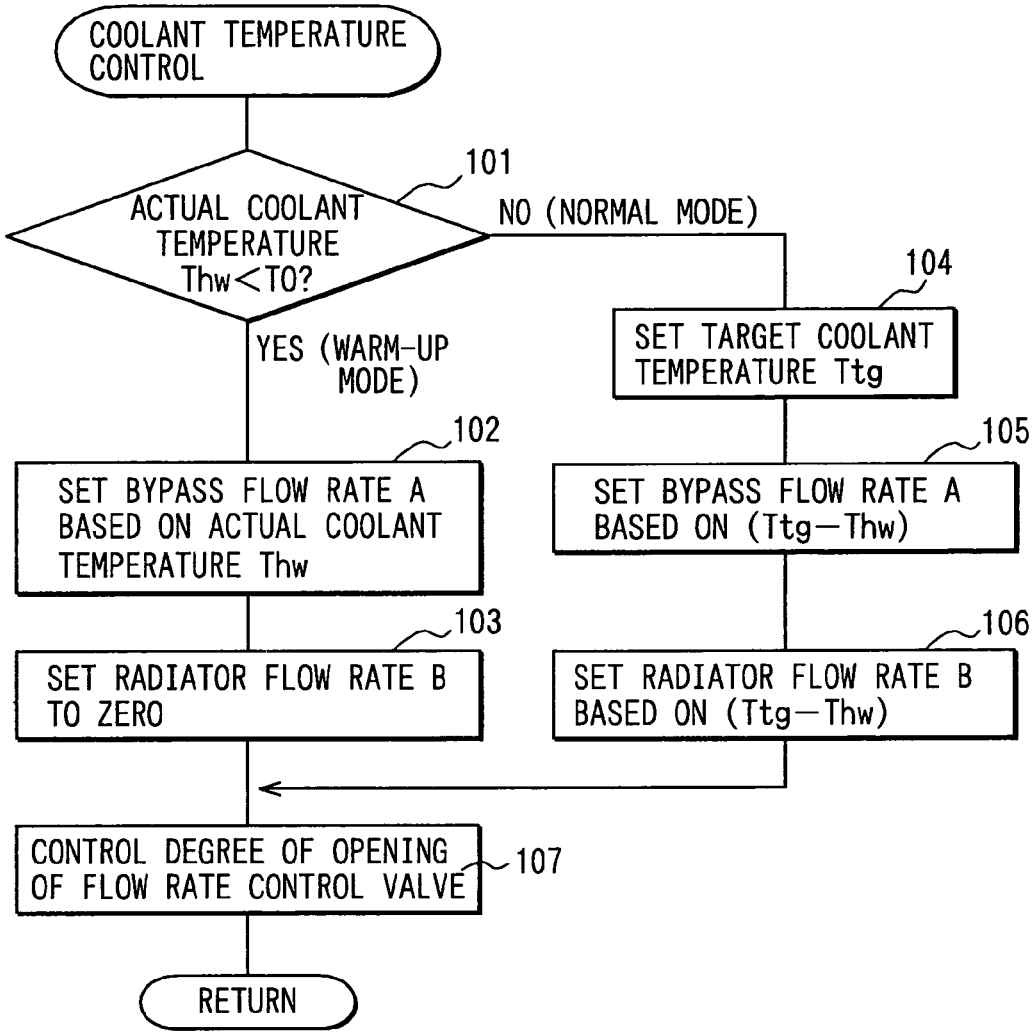
FIG. 2 is a flow chart showing a coolant temperature control routine of the embodiment.

The coolant temperature control routine of FIG. 2 is executed at predetermined intervals (e.g., every 100 ms) after turning on of an ignition switch (not shown) to serve as a coolant temperature control means of the present invention. Upon execution of the present routine, first at step 101, it is determined whether the actual coolant temperature Thw measured through the coolant temperature sensor 19 is lower than a predetermined warm-up end threshold temperature T0 (e.g., 80 degrees Celsius) to determine whether the warm-up of the engine 11 has been completed. When it is determined that the actual coolant temperature Thw is lower than the warm-up end threshold temperature T0, it is assumed that the warm-up of the engine 11 has not been completed, and the warm-up mode is selected on the other hand, when the actual coolant temperature Thw is equal to or greater than the warm-up end threshold temperature T0, it is assumed that the warm-up of the engine 11 has been completed, and the normal mode is selected.

When the actual coolant temperature Thw is lower than the warm-up end threshold temperature T0, and thus the warm-up mode is selected, control proceeds to step 102. At step 102, the bypass flow rate A of the warm-up mode is set based on the actual coolant temperature Thw. The bypass flow rate A of the warm-up mode is selected to be smaller than the bypass flow rate A of the normal mode. However, when the bypass flow rate A of the warm-up mode is excessively reduced, the cooling efficiency of the engine 11 is extremely reduced, causing seizing of the engine 11. Thus, the bypass flow rate A of the warm-up mode is set to a value, which does not cause seizing of the engine 11, based on the actual coolant temperature Thw. For example, the bypass flow rate A of the warm-up mode can be minimized to a level that prevents seizing of the internal combustion engine 11.

It should be noted that the parameter used for setting the bypass flow rate A of the warm-up mode is not limited to the actual coolant temperature. For example, the bypass flow rate A of the warm-up mode can be set using one or more of the operational state parameters (e.g., loads such as the engine rotational speed, the air intake pipe pressure, the intake air amount) of the engine 11, the intake air temperature, the outside temperature and the actual coolant temperature.

Thereafter, control proceeds to step 103 where the radiator flow rate B of the warm-up mode is set to 0 (zero).

Then, control proceeds to step 107 where the degree of opening of the flow rate control valve 18 is controlled to achieve the bypass flow rate A of the warm-up mode and the radiator flow rate B (=0) of the warm-up mode, which are set at steps 102, 103. In this way, during the warm-up mode, the flow of coolant to the radiator 13 is stopped to substantially eliminate the heat release from the coolant through the radiator 13, and the bypass flow rate A is reduced to reduce the circulation flow rate of coolant. As a result, the cooling efficiency of the engine 11 is reduced during the warm-up mode, and thus the warm-up of the engine 11 is promoted.

Thereafter, when the actual coolant temperature Thw is increased to a level equal to or greater than the predetermined temperature T0, and thus the normal mode is selected, control proceeds to step 104. At step 104, a target coolant temperature Ttg is set based on the operational state of the engine 11. At this time, when the engine 11 is under a high load operation, such as hill-climbing drive operation or high speed drive operation, the target coolant temperature Ttg is set to, for example, 90 degrees Celsius to prevent excessive temperature increase of coolant. On the other hand, when the engine 11 is under the normal operation other than the high load operation, the target coolant temperature Ttg is set to, for example, 100 degrees Celsius to reduce the mechanical loss and thereby to improve fuel consumption.

After the target coolant temperature Ttg is set, control proceeds to step 105. At step 105, the bypass flow rate A of the normal mode is set based on a difference between the target coolant temperature Ttg and the actual coolant temperature Thw. Thereafter, control proceeds to step 106 where the radiator flow rate B of the normal mode is set based on the difference between the target coolant temperature Ttg and the actual coolant temperature Thw.

Next, control proceeds to step 107. At step 107, the degree of opening of the flow rate control valve 18 is controlled to achieve the bypass flow rate A of the normal mode and the radiator flow rate B of the normal mode, which are set at steps 105 and 106. In this way, the actual coolant temperature Thw is controlled to, for example, around 100 degrees Celsius at the time of normal mode, and the actual control temperature Thw is controlled to, for example, around 90 degrees Celsius at the time of high load operation.

(Abnormality Diagnosis Routine)

The abnormality diagnosis routine shown in FIG. 4 is executed at predetermined intervals (e.g., every 100 ms) after turning on of the ignition switch and serves as the abnormality diagnosis means of the present invention. Upon execution of the present routine, first, at step 201, it is determined whether an abnormality diagnosis executable condition is satisfied by, for example, determining whether the engine 11 is in the warm-up mode. If the abnormality diagnosis executable condition is not satisfied (e.g., if the engine 11 is not in the warm-up mode), the present routine ends.

On the other hand, when the abnormality diagnosis executable condition is satisfied, an abnormality diagnosis process, which starts at step 202, is executed. In the warm-up mode, at which the abnormality diagnosis process is executed, the flow rate control valve 18 is controlled in such a manner that the flow of coolant to the radiator 13 is stopped, and the bypass flow rate A of the warm-up mode is adjusted to a level (i.e., a flow rate that does not cause seizing of the engine 11) smaller than the bypass flow rate A after completion of the warm-up of the engine 11.

When the abnormality diagnosis executable condition is satisfied, control proceeds to step 202. At step 202, a coolant temperature estimation routine (described below) shown in FIG. 5 is executed to compute the estimated coolant temperature Te.

Thereafter, control proceeds to step 203. At step 203, it is determined whether the estimated coolant temperature Te is higher than the predetermined coolant temperature Tk. When it is determined that the estimated coolant temperature Te is higher than the predetermined coolant temperature Tk at step 203, control proceeds to step 204. At step 204, it is determined whether the flow rate control valve 18 is abnormal by determining whether a deviation between the actual coolant temperature Thw and the estimated coolant temperature Te (i.e., absolute value of a difference between the actual coolant temperature Thw and the estimated coolant temperature Te) is greater than an abnormality determination threshold value Kref. The condition shown at step 204 of FIG. 4 serves as an abnormality diagnosis condition of the present invention.

At this time, when it is determined that the deviation between the actual coolant temperature Thw and the estimated coolant temperature Te is equal to or smaller than the abnormality determination threshold value Kref, control proceeds to step 206. At step 206, the flow rate control valve 18 is determined to be normal, and the present routine ends.

On the other hand, when it is determined that the deviation between the actual coolant temperature Thw and the estimated coolant temperature Te is greater than the abnormality determination threshold value Kref, control proceeds to step 205. At step 205, the flow rate control valve 18 is determined to be abnormal, and a warning lamp (not shown) provided in an instrument panel on the driver's side is lit or a warning indication is indicated on a warning indicator to warn the driver. Then, the abnormality information (abnormality code) is stored in a backup RAM (not shown) of the control circuit 20, and the present routine ends.

(Coolant Temperature Estimation Routine)

When the coolant temperature estimation routine shown in FIG. 5 is executed at step 202, a map of an increased coolant temperature ΔTup is searched at step 301, and the increased coolant temperature ΔTup is computed based on the engine operational parameters, such as the engine rotational speed Ne and the intake pipe pressure Pm, which relate to the amount of heat generated by the engine 11 (the amount of heat conducted from the engine 11 to the coolant). The increased coolant temperature ΔTup is an increased coolant temperature, which is estimated based on the amount of heat generated by the engine 11 upon assumption that there is no temperature decrease caused by release of the heat. The map of the increased coolant temperature ΔTup is constructed in such a manner that the increased coolant temperature ΔTup is increased when the amount of heat generated by the engine 11 is increased.

It should be noted that the parameters of the map used for computing the increased coolant temperature ΔTup are not limited to the engine rotational speed Ne and the intake pipe pressure Pm and can be other engine operational parameters, such as the intake air flow rate and the degree of opening of the throttle valve, which relate to the amount of air charged into the engine cylinder. Thus, it is only required to use the engine operational parameters that relate to the amount of heat generated by the engine 11 (i.e., the amount of heat conducted from the engine 11 to the coolant). Furthermore, the number of the parameters used in the computation of the increased coolant temperature ΔTup is not limited to two and can be one or alternatively can be equal to or greater than three. Furthermore, the increased coolant temperature ΔTup can be corrected using a correction factor, which corresponds to an elapsed time period since the time of engine start.

After the increased coolant temperature ΔTup is computed, control proceeds to step 302. At step 302, a map of a decreased coolant temperature ΔTdown is searched, and the decreased coolant temperature ΔTdown is computed based on the engine operational parameters, such as a vehicle speed SPD and a temperature difference between the estimated coolant temperature Te and the outside temperature Tout (Te−Tout), which relate to the amount of heat released from the coolant. The decreased coolant temperature ΔTdown is an decreased coolant temperature induced by release of heat from coolant, which is, in turn, caused by, for example, wind or air flow applied to the running vehicle or air flow blown by a radiator fan (not shown). The map of the decreased coolant temperature ΔTdown is constructed in such a manner that the decreased coolant temperature ΔTdown is increased when the vehicle speed SPD is increased (i.e., the wind applied to the running vehicle is increased), and also the decreased coolant temperature ΔTdown is increased when the temperature difference (Te−Tout) between the estimated coolant temperature Te and the outside temperature Tout is increased.

With respect to the parameters used for computing the decreased coolant temperature ΔTdown, in place of the temperature difference (Te−Tout) between the estimated coolant temperature Te and the outside temperature Tout, a temperature difference (Thw−Tout) between the actual coolant temperature Thw measured through the coolant temperature sensor 19 and the outside temperature Tout can be used. Furthermore, in place of the outside temperature Tout, the intake air temperature can be used. Also, the number of the parameters of the map used for computing the decreased coolant temperature ΔTdown is not limited to two and can be one or alternatively can be equal to or greater than three.

After the decreased coolant temperature ΔTdown is computed, control proceeds to step 303. At step 303, a map of an air conditioning state correction factor K1 is searched, and the air conditioning state correction factor K1 is computed based on an operational state of an air conditioning system (not shown), such as an operational state of a heater unit. The air conditioning state correction factor K1 is used to correct the decreased coolant temperature ΔTdown upon consideration of heat release from the coolant in the air conditioning system. For example, the map of the air conditioning state correction factor K1 is constructed in such a manner that the air conditioning state correction factor K1 is increased (i.e., the decreased coolant temperature ΔTdown is increased) when the rotational speed of a blower motor of the heater unit is increased or when a degree of opening of a valve, which controls an amount of cooling fluid (amount of hot water) supplied to the heater unit, is increased.

Figure 6:
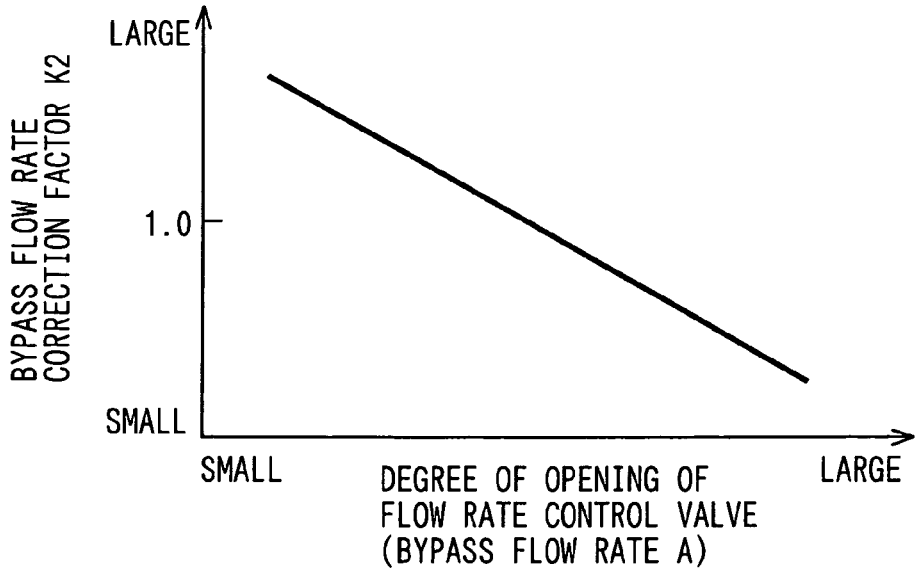
FIG. 6 is a diagram schematically showing a map of a bypass flow rate correction factor K2.

After the air conditioning state correction factor K1 is computed, control proceeds to step 304. At step 304, a map of a bypass flow rate correction factor K2 shown in FIG. 6 is searched, and the bypass flow rate correction factor K2 is computed based on the degree of opening of the flow rate control valve 18 (bypass flow rate A). In this case, when the bypass flow rate A is decreased, the circulation flow rate of coolant is decreased, resulting in a decrease in the cooling efficiency of the engine 11 (heat release efficiency) to cause a rapid increase of the coolant temperature. Thus, in the map of the bypass flow rate correction factor K2 shown in FIG. 6, the bypass flow rate correction factor K2 is increased when the degree of opening of the flow rate control valve 18 is decreased (i.e., when the bypass flow rate A is decreased).

After the bypass flow rate correction factor K2 is computed, control proceeds to step 305. At step 305, a currently estimated coolant temperature Te(i) is computed with the following equation based on the previously estimated coolant temperature Te(i−1), the increased coolant temperature ΔTup, the decreased coolant temperature ΔTdown, the air conditioning state correction factor K1 and the bypass flow rate correction factor K2. Here, the actual coolant temperature Thw can be used as an initial value of the estimated coolant temperature.

$$Te(i)=Te(i-1)+(\Delta Tup-\Delta Tdown\times K1)\times K2$$

According to the above described embodiment, existence of the abnormality of the flow rate control valve 18 is diagnosed through comparison of the actual coolant temperature Thw and the estimated coolant temperature Te at the time of warm-up of the engine 11. At the time of warm-up of the engine 11, a change in the coolant temperature (temperature increase) is relatively large, so that there is the increased difference in coolant temperature behaviors between the normal time of the flow rate control valve 18 and the abnormal time of the flow rate control valve 18. As a result, existence of the abnormality of the flow rate control valve 18 is relatively accurately diagnosed by comparing the actual coolant temperature Thw and the estimated coolant temperature Te at the time of warm-up of the engine 11.

In general, the behavior of the coolant temperature changes based on the amount of heat generated by the engine 11 (the amount of heat conducted from the engine 11 to the coolant) and the amount of heat released from the coolant. Upon consideration of such a fact, in the present embodiment, the estimated coolant temperature Te is computed based on the parameter, which is related to the amount of heat generated by the engine 11, and the parameter, which is related to the amount of heat released from the coolant. Thus, existence of the abnormality of the flow rate control valve 18 can be relatively accurately diagnosed using the appropriately estimated coolant temperature Te, which is determined upon consideration of the change in the coolant temperature behavior, which changes based on the amount of heat generated by the engine 11 and the amount of heat released from the coolant.

Furthermore, in the present embodiment, the bypass flow rate correction factor K2 is computed based on the degree of opening of the flow rate control valve 18, which correlates with the bypass flow rate A. Then, the estimated coolant temperature Te is computed based on this bypass flow rate correction factor K2. Thus, the estimated coolant temperature Te can be corrected in response to the change in the coolant temperature behavior caused by the bypass flow rate A, and thus the abnormality diagnosis accuracy of the flow rate control valve 18 can be further improved. Furthermore, the degree of opening of the flow rate control valve 18 is used as the parameter, which correlates with the bypass flow rate A. Thus, it is not required to directly measure the bypass flow rate A, and the system arrangement can be simplified.

Furthermore, in the present embodiment, at the time of performing the abnormality diagnosis (during the warm-up mode), the flow rate control valve 18 is controlled in such a manner that the flow of coolant to the radiator 13 is stopped, and the bypass flow rate A at the time of abnormality diagnosis (during the warm-up mode) is adjusted to a level smaller than the bypass flow rate A after completion of the warm-up of the engine 11. In this way, when the flow rate control valve 18 is properly operated at the time of abnormality diagnosis, the bypass flow rate A can be reduced to reduce the circulation flow rate of the coolant while the flow of coolant to the radiator 13 is stopped to substantially eliminate release of heat through the radiator 13. In this way, the cooling efficiency of the engine 11 (i.e., the heat release efficiency of coolant) is reduced, and thus the increase rate of the coolant temperature is accelerated. As a result, the difference in coolant temperature behaviors between the normal time of the flow rate control valve 18 and the abnormal time of the flow rate control valve 18 can be further increased. Therefore, the abnormality diagnosis accuracy of the flow rate control valve 18 can be further improved.

When the bypass flow rate A at the time of abnormality diagnosis is excessively reduced, the cooling efficiency of the engine 11 is substantially reduced to cause seizing of the engine 11. In the present embodiment, the bypass flow rate A at the time of abnormality diagnosis is set to the level that does not cause seizing of the engine 11, so that the bypass flow rate A is advantageously reduced within the range that prevents seizing of the engine 11 to improve the abnormality diagnosis accuracy of the flow rate control valve 18.

In the above embodiment, the abnormality diagnosis is performed based on the difference between the actual coolant temperature Thw and the estimated coolant temperature Te. Alternatively, it is possible to perform the abnormality diagnosis based on a ratio between the actual coolant temperature Thw and the estimated coolant temperature Te.

Furthermore, without using the estimated coolant temperature Te, the abnormality diagnosis can be performed by comparing the amount of change or a rate of change in the actual coolant temperature Thw with a corresponding abnormality determination threshold value. At that time, the abnormality determination threshold value can be set based on the parameter, which relates to the amount of heat generated by the engine 11 and the parameter, which relates to the amount of heat released from coolant. Furthermore, the actual coolant temperature Thw and the abnormality determination threshold value used in the abnormality diagnosis can be corrected based on the bypass flow rate A or a parameter (bypass flow rate parameter), which correlates with the bypass flow rate A.

Furthermore, in the above embodiment, the bypass flow rate is controlled by controlling the degree of opening of the flow rate control valve 18. However, in a case of a cooling system, which includes an electric water pump (flow rate control means) 21 (FIG. 1) driven by a motor in place of the mechanical water pump 12, the bypass flow rate can be adjusted by controlling a rotational speed (controlled variable) of the electric water pump 21. In this case, the rotational speed of the electric water pump 21 can be used as a bypass flow rate parameter.

Additional advantages and modifications will readily occur to those skilled in the art. The invention in its broader terms is therefore not limited to the specific details, representative apparatus, and illustrative examples shown and described.

What is claimed is:

1. An abnormality diagnosis apparatus for diagnosing abnormality of a recirculating liquid cooling system for an internal combustion engine, wherein the cooling system includes a radiator, a circulation line system, which circulates liquid coolant through the internal combustion engine and the radiator and includes a bypass fluid line that bypasses the radiator, a flow rate control means for controlling a bypass flow rate of liquid coolant flowing through the bypass fluid line, and a coolant temperature sensor, which measures coolant temperature in the circulation line system, the abnormality diagnosis apparatus comprising:

a coolant temperature control means for controlling the coolant temperature in the circulation line system by controlling the flow rate control means; and an abnormality diagnosis means for diagnosing the flow rate control means to determine whether an abnormality exists based on behavior of the measured coolant temperature, which is measured through the coolant temperature sensor during a warm-up period of the internal combustion engine.

2. An abnormality diagnosis apparatus as in claim 1, wherein the flow rate control means includes at least one of a valve and a pump inserted in the circulation line system.

3. An abnormality diagnosis apparatus as in claim 1, wherein the abnormality diagnosis means determines the existence of the abnormality of the flow rate control means based on one of:

an amount of change in the measured coolant temperature measured through the coolant temperature sensor; and a rate of change in the measured coolant temperature measured through the coolant temperature sensor.

4. An abnormality diagnosis apparatus as in claim 1, wherein the abnormality diagnosis means sets an abnormality diagnosis condition, which is used to determine the existence of the abnormality of the flow rate control means, based on:

a parameter, which relates to an amount of heat generated by the internal combustion engine; and a parameter, which relates to an amount of heat released from the coolant.

5. An abnormality diagnosis apparatus as in claim 4, wherein:

the abnormality diagnosis means determines an estimated coolant temperature of the coolant in the circulation line system based on:

the parameter, which relates to the amount of heat generated by the internal combustion engine; and the parameter, which relates to the amount of heat released from the coolant; and the abnormality diagnosis means determines the existence of the abnormality of the flow rate control means through comparison of the estimated coolant temperature and the measured coolant temperature measured through the coolant temperature sensor.

6. An abnormality diagnosis apparatus for diagnosing abnormality of a cooling system for an internal combustion engine, wherein the cooling system includes a radiator, a circulation line system, which circulates coolant through the internal combustion engine and the radiator and includes a bypass fluid line that bypasses the radiator, a flow rate control means for controlling a bypass flow rate of the coolant flowing through the bypass fluid line, and a coolant temperature sensor, which measures a coolant temperature of the coolant in the circulation line system, the abnormality diagnosis apparatus comprising:

a coolant temperature control means for controlling the coolant temperature of the coolant in the circulation line system, by controlling the flow rate control means; and an abnormality diagnosis means for diagnosing the flow rate control means to determine whether abnormality of the flow rate control means exists based on behavior of the measured coolant temperature, which is measured through the coolant temperature sensor during a warm-up period of the internal combustion engine;

wherein the abnormality diagnosis means corrects an abnormality diagnosis condition, which is used to determine the existence of the abnormality of the flow rate control means, based on one of:

the bypass flow rate; and a bypass flow rate parameter, which correlates with the bypass flow rate.

7. An abnormality diagnosis apparatus as in claim 6, wherein the abnormality diagnosis means uses a controlled variable of the flow rate control means as the bypass flow rate parameter.

8. An abnormality diagnosis apparatus for diagnosing abnormality of a cooling system for an internal combustion engine, wherein the cooling system includes a radiator, a circulation line system, which circulates coolant through the internal combustion engine and the radiator and includes a bypass fluid line that bypasses the radiator, a flow rate control means for controlling a bypass flow rate of the coolant flowing through the bypass fluid line, and a coolant temperature sensor, which measures a coolant temperature of the coolant in the circulation line system, the abnormality diagnosis apparatus comprising:

a coolant temperature control means for controlling the coolant temperature of the coolant in the circulation line system by controlling the flow rate control means; and an abnormality diagnosis means for diagnosing the flow rate control means to determine whether abnormality of the flow rate control means exists based on behavior of the measured coolant temperature, which is measured through the coolant temperature sensor during a warm-up period of the internal combustion engine;

wherein when the abnormality diagnosis means diagnoses the flow rate control means, the coolant temperature control means controls the flow rate control means in such a manner that the flow rate control means stops flow of the coolant to the radiator and sets the bypass flow rate of the coolant to a level less than the bypass flow rate set for a period after the warm-up period of the internal combustion engine.

9. An abnormality diagnosis apparatus as in claim 8, wherein when the abnormality diagnosis means diagnoses the flow rate control means, the coolant temperature control means sets the bypass flow rate of the coolant to a level that prevents seizing of the internal combustion engine.

10. A cooling system for an internal combustion engine, the cooling system comprising:

a radiator;

a circulation line system, which circulates liquid coolant through the internal combustion engine and the radiator and includes a bypass fluid line that bypasses the radiator;

a flow rate control means for controlling a bypass flow rate of the liquid coolant flowing through the bypass fluid line, wherein the flow rate control means continuously changes the bypass flow rate of the coolant;

a coolant temperature sensor, which measures a coolant temperature of the coolant in the circulation line system;

a coolant temperature control means for controlling the coolant temperature of the coolant in the circulation line system by controlling the flow rate control means; and an abnormality diagnosis means for diagnosing the flow rate control means to determine whether abnormality of the flow rate control means exists based on behavior of the measured coolant temperature, which is measured through the coolant temperature sensor during a warm-up period of the internal combustion engine.

11. A cooling system as in claim 10, wherein the flow rate control means includes at least one of a valve and a pump inserted in the circulation line system.

12. A cooling system as in claim 10, wherein the coolant temperature sensor is positioned between the internal combustion engine and the radiator.

13. A cooling system as in claim 10, wherein the abnormality diagnosis means determines the existence of the abnormality of the flow rate control means based on one of:

an amount of change in the measured coolant temperature measured through the coolant temperature sensor; and a rate of change in the measured coolant temperature measured through the coolant temperature sensor.

14. A cooling system as in claim 10, wherein the flow rate control means is a control valve that has a continuously variable degree of opening.

15. A method for diagnosing abnormality of a recirculating liquid cooling system for an internal combustion engine, wherein the cooling system includes a radiator, a circulation line system which circulates liquid coolant through the internal combustion engine, radiator and a bypass fluid line that bypasses the radiator and a coolant temperature sensor, said method comprising:

controlling coolant temperature by controlling flow rate of liquid through said bypass fluid line; and determining whether an abnormality exists based on behavior of the measured coolant temperature, measured by the coolant temperature sensor during a warm-up period of the internal combustion engine.

16. A method as in claim 15 wherein the control of bypass flow rate utilizes at least one of a valve and a pump disposed in the circulation line system.

17. A method as in claim 15 wherein the abnormality determination is based on one of:

change in the measured coolant temperature and rate of change in the measured coolant temperature.

18. A method as in claim 15 wherein an abnormality diagnosis condition is set and used to determine the existence of the abnormality based on:

a first parameter which relates to heat generated by the internal combustion engine; and a second parameter which relates to heat released from the coolant.

19. A method as in claim 18 wherein:

an estimated coolant temperature of the coolant in the circulation line system is estimated based on the first parameter and the second parameter; and existence of the abnormality is determined using a comparison of estimated coolant temperature and measured coolant temperature.

20. A method as in claim 15 wherein an abnormality diagnosis condition is corrected before being used to determine the existence of the abnormality based at least on one of:

the bypass flow rate; and a bypass flow rate parameter which correlates with the bypass flow rate.

21. A method as in claim 20 wherein a controlled variable related to the controlled flow rate is used as the bypass flow rate parameter.

22. A method as in claim 15 wherein, when the abnormality is being diagnosed, flow rate is controlled such that the flow of coolant to the radiator is stopped and bypass flow rate is set to a level less than that set for use after the warm-up period of the internal combustion engine.

23. A method as in claim 22 wherein, when the abnormality is being diagnosed, the bypass flow rate of coolant is set to a level that prevents seizing of the internal combustion engine.

24. A method for operating a recirculating liquid cooling system for an internal combustion engine, said method comprising:

circulating liquid coolant through the internal combustion engine and a circulation line system including a radiator and a bypass fluid line that bypasses the radiator;

controlling a variable flow rate of liquid coolant flowing through the bypass fluid line;

measuring coolant temperature;

controlling the coolant temperature by variably controlling the bypass flow rate; and determining whether abnormality of flow rate control exists based on behavior of the coolant temperature during a warm-up period of the internal combustion engine.

25. A method as in claim 24 wherein variable control of flow rate includes use of at least one of a valve and a pump disposed in the circulation line system.

26. A method as in claim 24 wherein the coolant temperature sensor is positioned between the internal combustion engine and the radiator.

27. A method as in claim 24 wherein the determination of an abnormality is based on at least one of:

change in the measured coolant temperature; and rate of change in the measured coolant temperature.

28. A method as in claim 24 wherein variable flow rate control is achieved using a control valve that has a continuously variable degree of opening.

* * * * *